US005823481A

United States Patent [19]

Gottschlich

[11] Patent Number: 5,823,481

[45] Date of Patent: Oct. 20, 1998

[54] METHOD OF TRANSFERRING CONTROL OF A RAILWAY VEHICLE IN A COMMUNICATION BASED SIGNALING SYSTEM

[75] Inventor: Kenneth M. Gottschlich, Pittsburgh, Pa.

[73] Assignee: Union Switch & Signal Inc., Pittsburgh, Pa.

[21] Appl. No.: 726,526

[22] Filed: Oct. 7, 1996

[51] Int. Cl.[6] ..... B61L 21/00

[52] U.S. Cl. ..... 246/28 R; 246/62; 364/424.024

[58] Field of Search ..... 246/2 F, 2 S, 20, 246/21, 22, 23, 24, 27, 28 R, 31, 34 R, 34 B, 62, 122 R, 167 R, 182 R, 182 B, 182 C, 167 D, 34 A; 364/424.024, 426.05

[56] References Cited

U.S. PATENT DOCUMENTS

| | | | |
|---|---|---|---|
| 3,251,989 | 5/1966 | Hughson | 246/28 R |
| 3,710,100 | 1/1973 | Perry | 246/28 R |
| 3,794,977 | 2/1974 | Thorne-Booth et al. | 246/182 R |
| 3,901,468 | 8/1975 | Cochran et al. | 246/28 R |
| 3,967,801 | 7/1976 | Baughman | 246/182 R |
| 4,002,314 | 1/1977 | Barpal | 246/182 R |
| 4,619,425 | 10/1986 | Nagel | 246/34 |
| 5,092,544 | 3/1992 | Petit et al. | 246/126 |
| 5,263,669 | 11/1993 | Ehrlich | 246/34 B |
| 5,330,135 | 7/1994 | Roberts | 246/34 B |
| 5,398,894 | 3/1995 | Pascoe | 246/62 |
| 5,459,663 | 10/1995 | Franke | 246/122 R |

*Primary Examiner*—Mark T. Le
*Attorney, Agent, or Firm*—Kevin A. Sembrat

[57] ABSTRACT

A method is provided for transferring control of a railway vehicle from a controlling wayside controller that controls a first zone within which the railway vehicle was previously positioned, to an adjacent wayside controller that controls a second zone within which the railway vehicle has traveled, wherein the second zone is adjacent to the first zone and separated from the first zone by a predetermined boundary in a communication based signaling system. The method utilizes information requests and control transfer requests that are transmitted and received by each of the controlling wayside controller and the adjacent wayside controller and the railway vehicle in accordance with method steps which are performed asynchronously, independently, and in parallel for each of the controlling wayside controller, the adjacent wayside controller, and the railway vehicle. Advantages of the method of the present invention include the elimination of the need for constant exchange of information about the states of wayside control zones which are adjacent to the zone controlled by the wayside controller which controls the railway vehicle, and the elimination of the need for two wayside controllers which are separated by a predetermined boundary to have full knowledge of the state of the wayside.

36 Claims, 11 Drawing Sheets

METHOD OF TRANSFERRING CONTROL OF A RAILWAY VEHICLE IN A COMMUNICATION BASED SIGNALING SYSTEM

BACKGROUND OF THE INVENTION

1. Field of the Invention

The present invention relates generally to a method of transferring control of a railway vehicle and, more particularly, to a request-based method of transferring control of a railway vehicle from a first wayside controller to a second wayside controller in a communication based signaling system.

2. Description of the Related Art

In the related art, traffic flow through signal territory is typically directed by various signal aspects appearing on wayside indicators or cab signal units located on board the vehicles. The vehicle operators recognize each such aspect as indicating a particular operating condition allowed at that time. Typical practice is for the aspects to indicate prevailing speed conditions.

In a conventional "fixed block" or "track-circuit" based system, the track is typically divided into cascaded sections known as "blocks". These blocks, which may be generally as long as two to three miles or as short as a few hundred feet, are electrically defined from adjacent blocks typically utilizing interposing insulated joints or shunt paths. These fixed blocks are used to describe the track layout and related equipment that is associated with particular positions on a track circuit. When a block is unoccupied, track circuit apparatus connected at each end are able to transmit signals back and forth through the rails within the block. Such signals may be coded to contain control data enhancing the signaling operation. Track circuits operating in this manner are referred to as "coded track circuits". One such coded track circuit is illustrated in U.S. Pat. No. 4,619,425, issued Oct. 28,1986 in the name of Nagel, and which is hereby incorporated herein by reference in its entirety. When a block is occupied by a railway vehicle, shunt paths are created across the rails by the vehicle wheel and axle sets. While this shunt path interrupts the flow of information between respective ends of the block, the presence of the vehicle can be positively detected.

In fixed block signaling systems, since there is little need for extensive description of the track circuit for automatic equipment to use in real time, there is relatively little intelligence in the automatic equipment. However, a change in railway signaling technology from the conventional "fixed block" for "track-circuit" based signaling system to a "moving block" communication-based signaling system has increased control performance by providing an improved positioning of a vehicle or wayside component according to the precise position that the vehicle or wayside component is situated on the track, rather than providing the conventional identification of a particular "block" of track in which the vehicle is positioned.

The present signaling systems constantly transfer the state of wayside controller border zones between adjacent wayside controllers. Traditional fixed block systems are concerned with track circuit occupancies rather than control of particular railway vehicles; therefore, no hand off of the control of the railway vehicle occurs from one wayside controller to another. Instead, signals are set in accordance with the occupancies of one or more track circuits ahead of the signal.

As mentioned, the advent of the next generation of communication-based signaling systems which are not based on track circuits makes possible the identification of an exact position of a particular train and the assignment of responsibility for that railway vehicle to a specific wayside controller.

Consequently, a need has been felt for a method of handing off responsibility and thereby transferring control of a railway vehicle from one wayside controller to an adjacent wayside controller in a communication-based signaling system.

SUMMARY OF THE INVENTION

It is therefore an object of the present invention to provide a method of transferring control of a railway vehicle from a first wayside controller to an adjacent wayside controller in a communication-based signaling system.

It is a feature of the method of the present invention to transmit requests for information and control transfer between a controlling wayside controller and an adjacent wayside controller.

It is another feature of the method of the present invention for the controlling wayside controller to initiate the transfer of control by transmitting a request message to an adjacent wayside controller.

It is another object of the present invention to provide a method of granting clearance in the form of a "target path" for a railway vehicle into an adjacent wayside controller's region of responsibility.

Briefly described according to one embodiment of the present invention, a method is provided for transferring control of a railway vehicle that is traveling in a first direction, from a controlling wayside controller that controls a first zone within which the railway vehicle was previously positioned, to an adjacent wayside controller that controls a second zone within which the railway vehicle has traveled, wherein the second zone is adjacent to the first zone and separated from the first zone by a predetermined boundary in a communication-based signaling system. The railway track system upon which the railway vehicle travels is segmented into predetermined independent zones, each zone of which is controlled by an independently operating wayside controller. Each independently operating wayside controller has responsibility for an independent zone of the railway track system so that each of every independent zone of the railway track system is controlled by only one particular wayside controller. A first zone of control is segmented from a second zone of control by a predetermined boundary.

A sighting distance is defined as a distance required to guarantee that the vehicle is able to stop safely before colliding with or encountering an obstacle. The sighting distance for the railway vehicle is known by the wayside controller which controls the zone in which the railway vehicle is positioned. When the sighting distance extends from a first zone, past the predetermined boundary and into a second adjacent zone, the controlling wayside controller transmits a request for clearance from the adjacent wayside controller on the opposite side of the predetermined boundary. This request for clearance includes the length past the predetermined boundary that the sighting distance extends into the adjacent zone. The adjacent wayside controller transmits a reply according to the amount of clearance requested and the amount of clearance available in the adjacent zone relative to a particular target in the adjacent zone. When the railway vehicle has crossed the predetermined boundary such that the railway vehicle is positioned within the adjacent zone, the controlling wayside controller transmits a request to transfer control to the adjacent wayside controller that is controlling the adjacent zone within which the railway vehicle is now positioned. Upon receipt of an acknowledgment reply transmitted from the adjacent wayside controller, the controlling wayside controller releases control of the railway vehicle and transmits an acknowledgment message that control of the railway vehicle has been released by the controlling wayside controller. Upon receipt of the acknowledgment message by the adjacent wayside controller, the adjacent wayside controller retains control of the railway vehicle. The controlling wayside controller is operated by a first microprocessor and transmits signals for receipt by the railway vehicle and by the adjacent wayside controller. The railway vehicle is operated by a second microprocessor. Each adjacent wayside controller is operated by a microprocessor which is independent of the first microprocessor and the second microprocessor.

An advantage of the method of the present invention is the elimination of a need for constant exchange of information about the states of the adjacent wayside control zones.

Another advantage of the method of the present invention is the elimination of the need for both controllers which are separated by a boundary to have full knowledge of the state of the wayside.

Another advantage of the method of the present invention is that clearance is provided in the form of a target path transmitted to the railway vehicle from the controlling wayside controller.

Another advantage of the method of the present invention is that only one wayside controller may have responsibility for controlling the railway vehicle at any one time.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
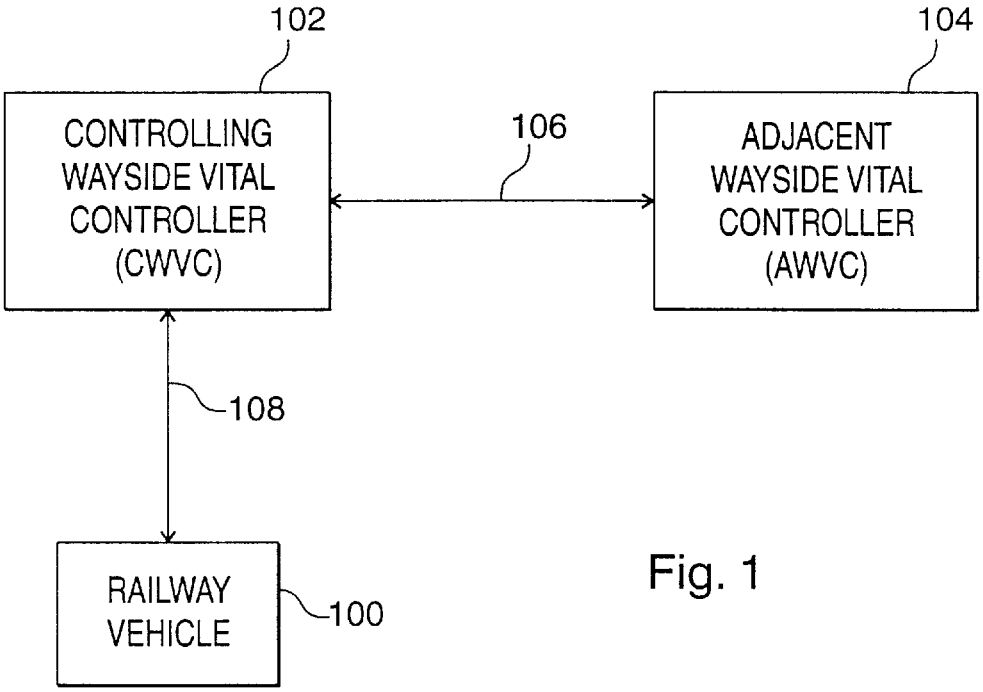
FIG. 1 is a general block diagram showing the communication links between a railway vehicle, a controlling wayside vital controller, and an adjacent wayside controller in a communication-based signaling system, according to the method of the present invention.

Referring now to the drawings, FIG. 1 is a block diagram showing the communication links between a railway vehicle 100, a controlling wayside vital controller (CWVC) 102, and an adjacent wayside vital controller (AWVC) 104 in a communication-based signaling system (not shown), according to the method of the present invention. A "vital" device is known in the art as being designed such that in the event of a failure, the vital device will default to a status that will maximize the safety of the railway vehicle. Bi-directional communication link 106 indicates that the CWVC 102 transmits to and receives from the AWVC 104, and the AWVC 104 transmits to and receives from the CWVC 102. Bi-directional communication link 108 indicates that the CWVC 102 transmits to and receives from the railway vehicle 100 and the railway vehicle 100 transmits to and receives from the CWVC 102. Although no reply from the railway vehicle is expected or received by the CWVC 102 in accordance with a preferred embodiment of the method of the present invention, the railway vehicle 100 periodically transmits information such as a vehicle position indication (not shown) for use by the particular controlling wayside vital controller that is controlling the railway vehicle 100. Each of the CWVC 102, the AWVC 104, and the railway vehicle 100 are operated by its own data processor (not shown). Each processor is operated asynchronously relative to the other processors with its own predetermined period.

Figure 2:
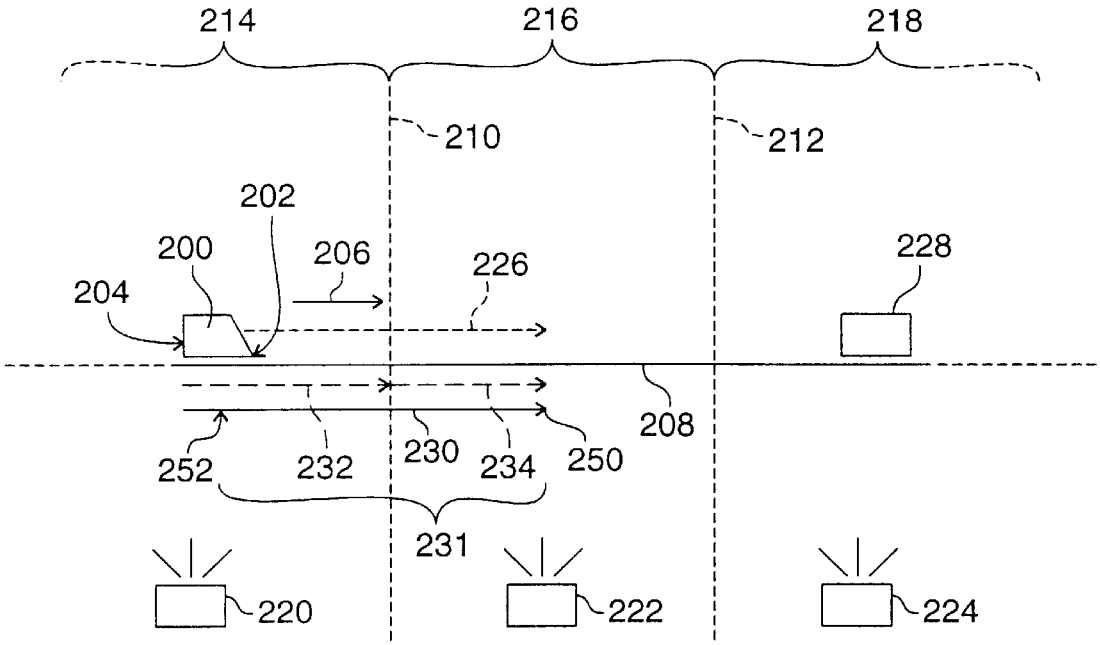
FIG. 2 is a diagrammatic representation of various target paths of a railway vehicle approaching a zone boundary, in accordance with the present invention.

FIG. 2 is a diagrammatic representation of various target paths (more fully described below) of a railway vehicle 200 in accordance with a preferred method of the present invention. The railway vehicle 200 has a head 202 and a tail 204, and is traveling in a direction 206 upon a rail 208. The rail 208 is segmented by a predetermined boundary 210 and a predetermined boundary 212. The predetermined boundary 210 distinguishes a zone 214 from a zone 216. The predetermined boundary 212 distinguishes the zone 216 from a zone 218. The zones 214, 216, 218 are monitored by the wayside vital controllers (WVCs) 220, 222, 224, respectively. When the railway vehicle is positioned within the zone 214, the railway vehicle 200 is controlled by the WVC 220. When the railway vehicle 200 crosses the predetermined boundary 210 such that the entire vehicle 200, including the tail 204, is within the zone 216, control of the railway vehicle 200 is transferred from the WVC 220 to the WVC 222. Similarly, when the railway vehicle 200 crosses the predetermined boundary 212, such that the entire vehicle 200, including tail 204, is positioned within the zone 218, control of the railway vehicle 200 is transferred from the WVC 222 to the WVC 224. The WVCs 220, 222, 224 operate independently and asynchronously relative to each other with their own predetermined period, thereby to monitor the zones 214, 216, 218 respectively and to retain control of the railway vehicle 200 via communication links (refer to FIG. 1) when the railway vehicle 200 is positioned within the zone 214, 216, 218 respectively, in accordance with a preferred method of the present invention.

As shown in FIG. 2, the railway vehicle 200 has a sighting distance 226, defined as a distance required to guarantee that the vehicle 200 is able to stop safely before colliding with or encountering an obstacle. The sighting distance 226 for the railway vehicle 200 is known by the wayside controller 220 which controls the zone 214 in which the railway vehicle 200 is positioned. The sighting distance 226 is preferably designed to be slightly more than a safe braking distance (not shown) at a maximum speed (not shown) plus a predetermined distance (not shown) due to a vehicle operator's (not shown) reaction time. Whenever the railway vehicle's sighting distance 226 extends past the predetermined boundary 210, and into the adjacent zone 216, it is desirable that clearance is provided into the adjacent zone 216. For the railway vehicle 200 to move at full speed and still maintain safe braking distance from a target object 228, the railway vehicle 200 requires a final target path 230 that is at least as long as its sighting distance 226.

To describe a target path, the concept of a path is first described. A path, typically used by automatic signaling equipment in communication based signaling systems, is described more fully in pending U.S. patent application, Ser. No. 08/585,577, which application is hereby incorporated herein by reference in its entirety. In general, a path represents a particular contiguous linear region along a railway system, and has characteristics that designate length, direction, and particular rail-switch settings. A path includes a beginning location on a particular branch (refer to Ser. No. 08/585,577), an ending location, and a list of branches connecting the beginning location and the ending location. Connection of one branch to another in a path designates a proper switch connection.

Moreover, in accordance with the present invention, the final target path 230 is generally defined as a path which designates a region 231 in which a railway vehicle is permitted to proceed. At all times, the railway vehicle must be completely within the region 231 defined by the final target path 230. A target 250, is designated as the end of the final target path 230. The target 250 may not be passed by the railway vehicle 200. As such, the final target path 230 must be periodically updated when the railway vehicle is in motion. The WVC 220, which controls the railway vehicle 200 while the railway vehicle is positioned within the zone 214, is responsible for maintaining the final target path 230 and periodically transmitting to the railway vehicle 200 an updated final target path which reflects the changing position of the railway vehicle 200 and the state of the WVCs 220, 222, 224. The target 250 may not be moved backwards—toward a beginning 252 of the final target path 230. The target 250 may only be moved forward—away from the beginning 252 of the final target path 230—thereby to guarantee that the railway vehicle 200 is not positioned outside of the final target path 230. The beginning 252 of the final target path 230 is moved with movement of the railway vehicle 200, thereby to keep the railway vehicle always completely within the final target path 230.

Because the WVC 220 does not have knowledge of the status of the adjacent zone 216 which is controlled by the WVC 222, the WVC 220, which currently controls the movement of the railway vehicle 200 through the zone 214, cannot, on its own authority, grant clearance into the adjacent zone 216 or issue to the railway vehicle 200 the target path 230 which extends into the adjacent zone 216.

Therefore, in accordance with the method of the present invention, the controlling WVC 220 generates a preliminary target path 232 which extends from the tail 204 to the predetermined boundary 210 and transmits a request to the WVC 222 for information related to how far within the sighting distance 226 that the railway vehicle 200 may travel into the zone 216. The WVC 222, which is adjacent the WVC 220, generates an adjacent zone target path 234 which extends from the predetermined boundary 210 and includes the amount of sighting distance that extends into the zone 216. The adjacent WVC 222 transmits the adjacent zone target path 234 to the WVC 220 which continues to control the railway vehicle 200. Upon receipt of transmission of the adjacent zone target path 234 by the WVC 222, the controlling WVC 220 appends the adjacent zone target path 234 to the preliminary target path 232—thereby to generate the final target path 230 and transmits the final target path 230, to the railway vehicle 200 —thereby to provide clearance up to the full sighting distance 226 for the current cycle of the data processor of the WVC 220—in accordance with a preferred embodiment of the method of the present invention.

Figure 3:
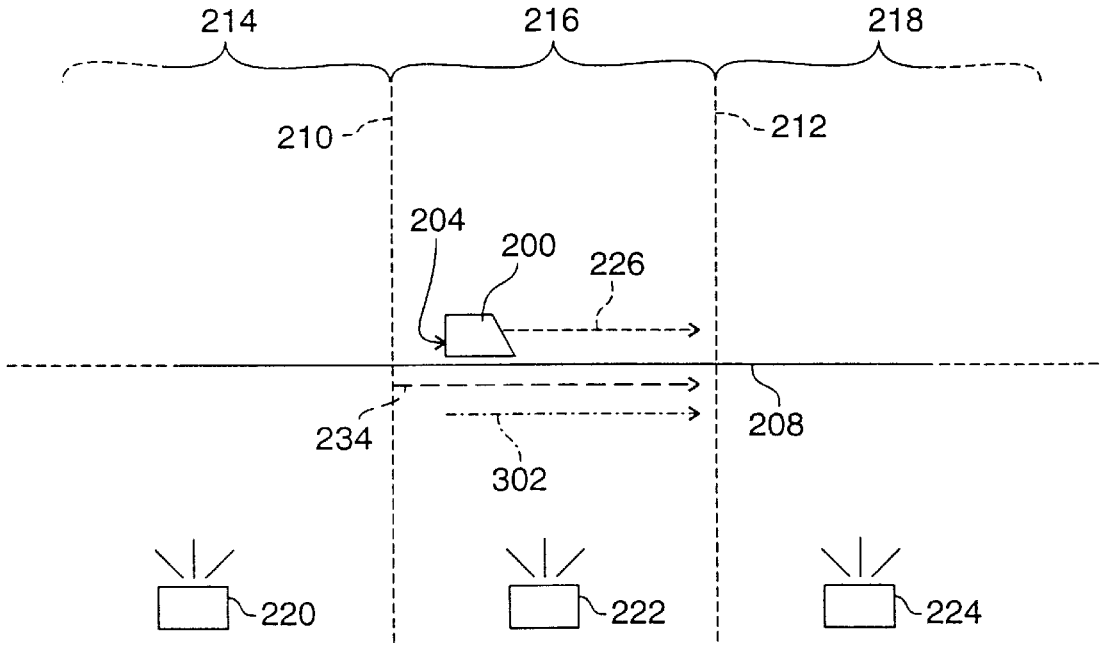
FIG. 3 is a diagrammatic representation of various target paths of a railway vehicle having a sighting distance that is completely within one zone.

FIG. 3 shows a diagrammatic representation of the railway vehicle 200 which has progressed along the rail 208 so that the tail 204 has crossed the predetermined boundary 210. Before control of the railway vehicle 200 is transferred from the WVC 220, the WVC 222 continues to generate periodically and then to transmit to the WVC 220 the adjacent zone target path 234 which extends from the predetermined boundary 210 and includes the amount of the sighting distance 226 that extends into the zone 216. In FIG. 3, the sighting distance 226 is of short enough length to remain fully within the zone 216 without crossing the predetermined boundary 212 when the tail 204 of the railway vehicle 200 has just crossed the predetermined boundary 210. As further described herein, the railway vehicle 200 continues periodically to transmit a vehicle position to the controlling wayside vital controller, which is the WVC 220 before control is transferred to the adjacent wayside vital controller, which is the WVC 222. When the controlling WVC 220 recognizes that the railway vehicle 200 is completely outside the zone 214 which is controlled by the WVC 220, the WVC 220 transmits a "hand-off" request message to the WVC 222. The WVC 222 transmits an acknowledgment message to the WVC 220 after confirming that control of the railway vehicle is acceptable by the WVC 222. Upon receipt of the acknowledgment message by the WVC 220, transfer of control from the WVC 220 to the WVC 222 is achieved in the manner described below. After control of the railway vehicle 200 is transferred to the WVC 222, the WVC 222 becomes the controlling wayside vital controller and the WVC 224 becomes the adjacent wayside vital controller while the railway vehicle progresses through the zone 216 in the direction 206, and the WVC 220 becomes an adjacent wayside vital controller if the railway vehicle progresses through the zone 216 in a direction which opposes the direction 206. When the WVC 222 is the controlling wayside vital controller, the WVC 222 generates and then transmits to the railway vehicle 200 a normal target path 302 which extends from the tail 204 of the railway vehicle 200 and includes the amount of the sighting distance 226 that extends into the zone 216. The normal target path 302 is transmitted periodically by the controlling WVC 222, and the railway vehicle 200 now periodically transmits its train position message to the controlling WVC 222 because the WVC 222 is the wayside vital controller that is now transmitting the normal target path 302.

Figure 4A:
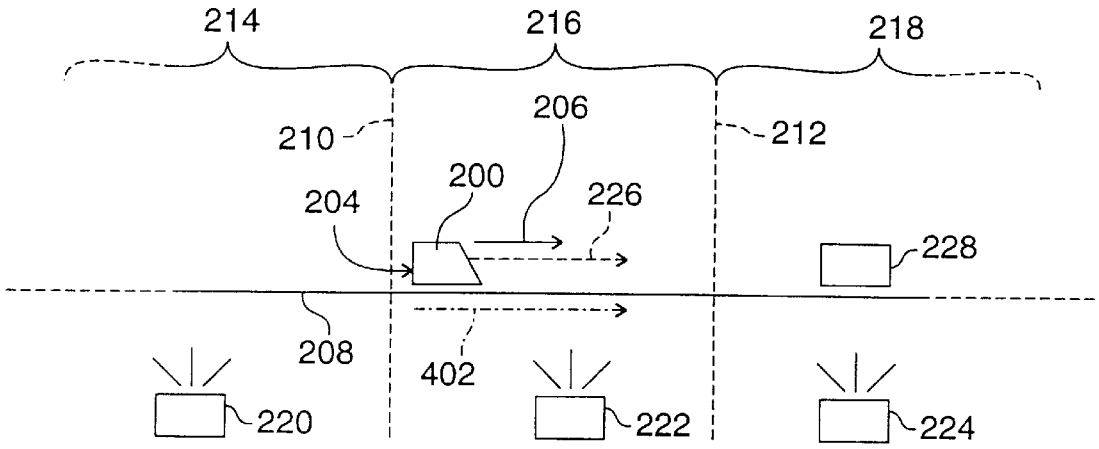
FIGS. 4*a–e* are various diagrammatic representations of a railway vehicle with corresponding target paths as the railway vehicle travels along a rail from a first zone and into a second zone, according to the method of the present invention.

Referring now to FIGS. 4*a–e*, various diagrammatic representations are shown of the railway vehicle 200 progressing in the direction 206 along the rail 208 through the zone 216 and into the zone 218. In FIG. 4*a*, the WVC 222 controls the railway vehicle 200 by periodically transmitting a normal target path 402 which extends from the tail 204 and includes the length of the sighting distance 226 that extends into the zone 216. The WVCs 220 and 224 are adjacent wayside vital controllers to the WVC 222 while the WVC 222 controls the railway vehicle 200; however, no request for an adjacent zone target path is transmitted by the WVC 222 until the railway vehicle progresses along the rail 208 so that the sighting distance 226 extends beyond the predetermined boundary 210 and into the zone 214, or beyond the predetermined boundary 212 and into the zone 218, respectively. While traveling in the direction 206, the railway vehicle 200 approaches the target object 228 positioned within the zone 218.

Figure 4B:
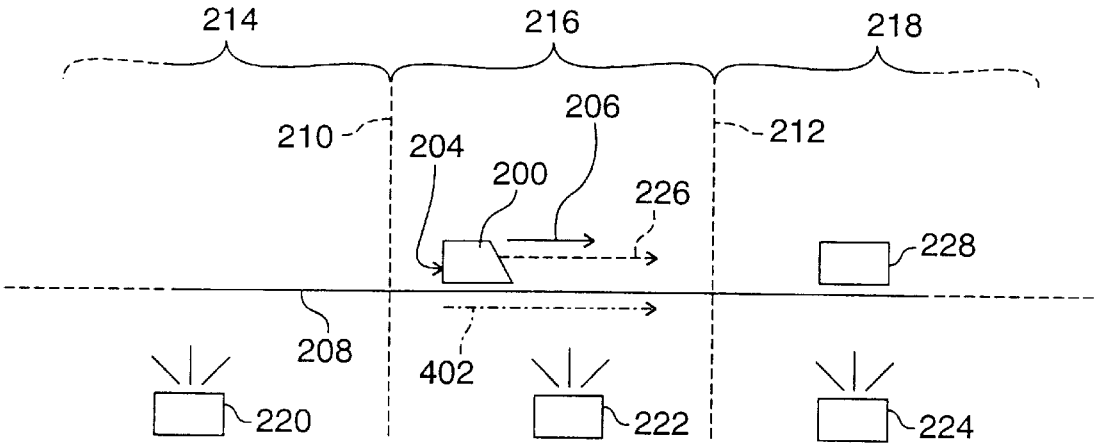

In FIG. 4*b*, the railway vehicle 200 has proceeded in the direction 206 along the rail 208, but the sighting 226 has not yet extended past the predetermined boundary 212. As such, the periodic generation and transmission to the railway vehicle 200 by the WVC 222 which continues to control the railway vehicle 200 is the normal target path 402.

Figure 4C:
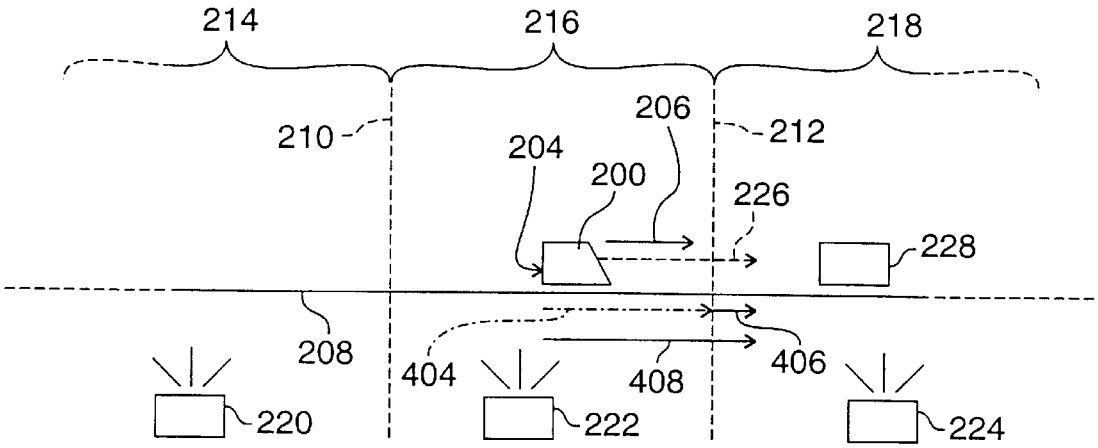

In FIG. 4*c*, the WVC 222 continues to control the railway vehicle 200 which proceeds along the rail 208 in the direction 206 through the zone 216. However, in FIG. 4*c*, the sighting distance 226 extends beyond the predetermined boundary 212 and into the zone 218. As such, in accordance with the method of the present invention, the WVC 222 generates a preliminary target path 404 which extends from the tail 204 to the predetermined boundary 212, and transmits a request to the WVC 224 for information related to how far within the sighting distance 226 that the railway vehicle 200 may travel into the zone 218. The WVC 224, which is adjacent the WVC 222, generates an adjacent zone target path 406 which extends from the predetermined boundary 212 and includes the amount of sighting distance that extends into the zone 218. The WVC 224 transmits the adjacent zone target path 406 to the WVC 222 which currently controls the railway vehicle 200. Until receipt of the adjacent zone target path 406 by the WVC 222 from the WVC 224, the WVC 222 continues to transmit periodically the preliminary target path 404 as a final target path to the vehicle 200.

Upon receipt of transmission of the adjacent zone target path 406, the WVC 222 appends the adjacent zone target path 406 to the preliminary target path 404 thereby to generate a final target path 408. The WVC 222 transmits the final target path 408 to the railway vehicle 200, thereby to provide clearance up to the full sighting distance 226 for the current cycle of the data processor of the WVC 200, in accordance with the preferred embodiment of the method of the present invention.

Figure 4D:
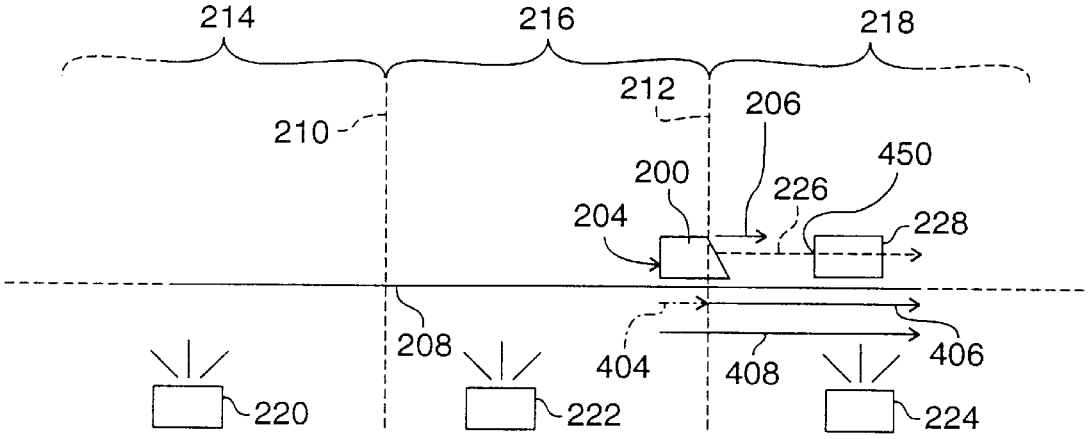

In FIG. 4*d*, the railway vehicle has progressed along the rail 208 far enough such that the sighting distance 226 extends past the target object 228. Since the sighting distance 226 extends beyond the predetermined boundary 212 and into the zone 218, the WVC 222 which controls the railway vehicle generates the preliminary target path 404 which extends from the tail 204 to the predetermined boundary 212 and transmits a request to the adjacent WVC 224 for information related to how far within the sighting distance 226 that the railway vehicle 200 may travel into the zone 218. In the scenario of FIG. 4*d*, the railway vehicle 200 may travel only up to a front edge 450 of the target object 228 (without touching the front edge 450) in order to avoid colliding with the target object 228. As such, the WVC 224 which is adjacent to the WVC 222, generates an adjacent zone target path 406 which extends from the predetermined boundary 212 and includes the amount of sighting distance that extends into the zone 218 and up to but directly before the front edge 450. The adjacent WVC 224 transmits the adjacent zone target path 406 to the WVC 222. Upon receipt of the transmission, the WVC 222 appends the adjacent zone target path 406 to the preliminary target path 404 thereby to generate the final target path 408, which final target path 408 extends from the tail 204 to directly before the front edge 450 of the target object 228. The WVC 222 transmits the final target path 408 to the railway vehicle 200, thereby to provide clearance up to directly before the front edge 450 of the target object 228 for the current cycle of the data processor of the WVC 222.

Figure 4E:
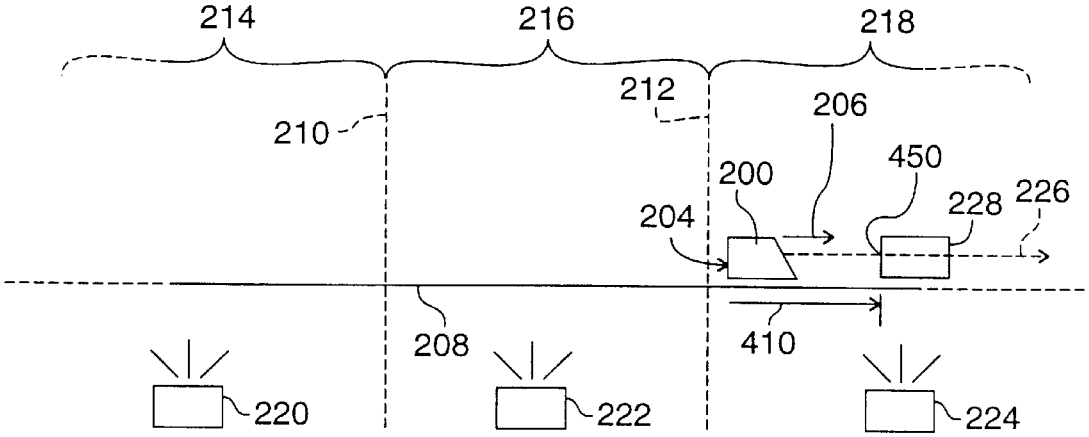

In FIG. 4*e*, the tail 204 of the railway vehicle 200 has crossed the predetermined boundary 212 and as such, control of the railway vehicle 200 has transferred from the WVC 222 to the WVC 224 in accordance with the method of the present invention. Now that the WVC 224 controls the railway vehicle 200, the WVC 224 generates and transmits to the railway vehicle 200 a normal target path 410 which extends from the tail 204 to the front edge 450 of the target object 228, thereby to provide clearance up to directly before the front edge 450 for the current cycle of the data processor of the WVC 224, in accordance with the method of the present invention.

Figure 5:
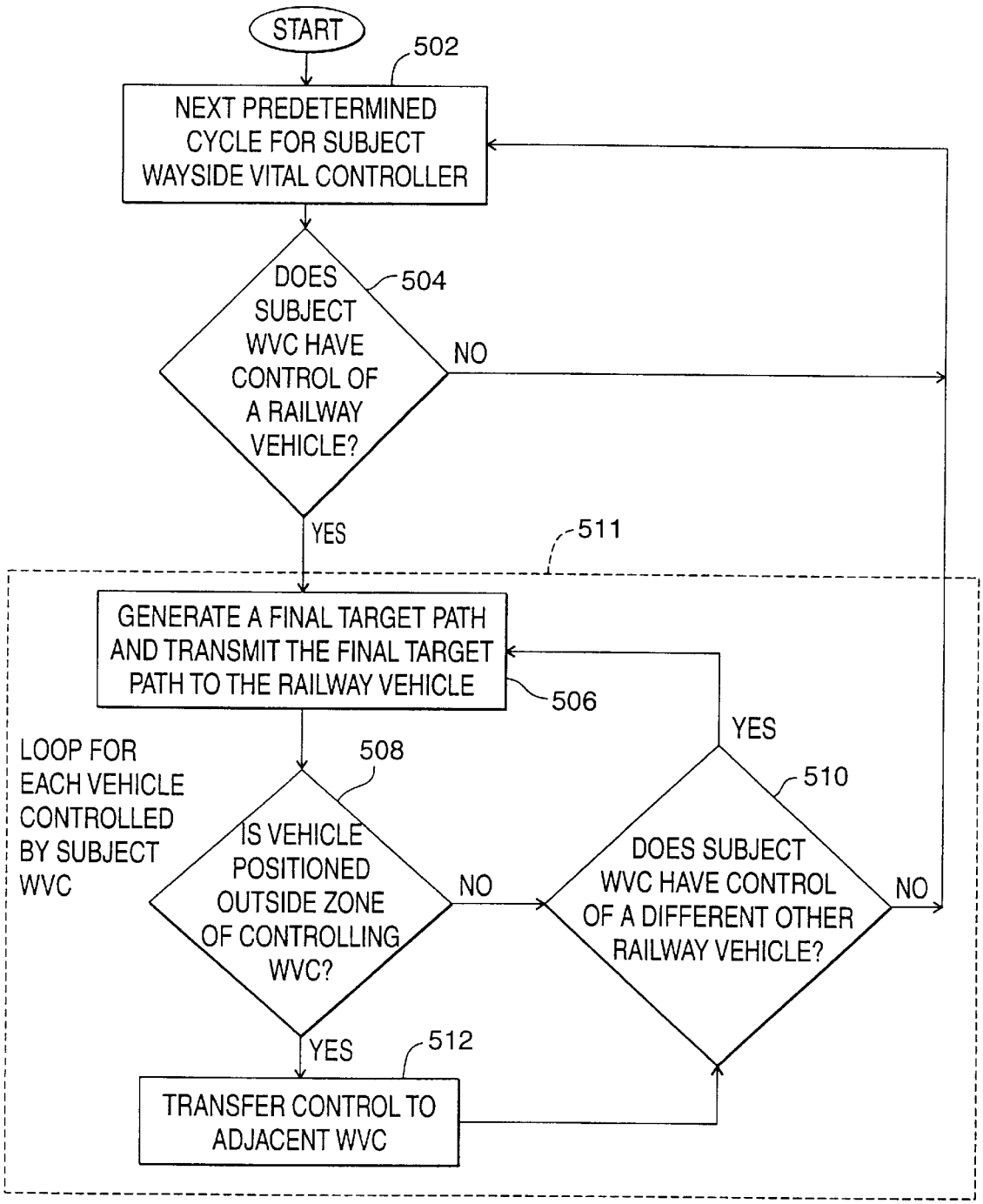
FIG. 5 is a high level flow diagram depicting transfer and monitoring steps performed by a controlling wayside controller in accordance with the method of the present invention.

FIG. 5 is a high level flow diagram depicting the basic target path generation and transfer steps performed by each of the wayside vital controllers which control a particular zone of the railway system in accordance with the method of the present invention. For a particular subject wayside vital controller, the subject WVC waits for the next predetermined cycle for that wayside vital controller in function block 502. The predetermined cycle defines a periodic time period, such as, for instance, a predetermined number of milliseconds. The predetermined cycle for each wayside vital controller may have a different time period than the predetermined cycle for each of all other wayside vital controllers in the railway system; though, typically, one predetermined cycle for one wayside vital controller has the same time period as that of another wayside vital controller.

At the next predetermined cycle, a determination is made in decision block 504 as to whether the subject WVC has control of at least one railway vehicle. If not, the process goes to function block 502. However, if the subject WVC has control of at least one railway vehicle, in function block 506, the subject WVC generates and transmits to the subject railway vehicle a final target path, which specifies clearance for the subject railway vehicle either toward or into the adjacent zone. Then a determination is made in decision block 508 as to whether the railway vehicle is positioned outside the zone controlled by the subject wayside controller. If not, a decision is made in decision block 510 as to whether the subject WVC controls another railway vehicle that is different than the other railway vehicle(s) controlled by the subject WVC and for which a final target path has been generated and transmitted in function block 506. In this manner, as designated by dotted looping block 511, the process loops for each and every railway vehicle controlled by the subject WVC, thereby to generate and transmit a final target path to each railway vehicle and, within each predetermined cycle for the subject wayside controller, to transfer control of each controlled railway vehicle that moves outside of the zone controlled by the subject WVC. When all railway vehicles controlled by the subject WVC have had a final target path generated and transmitted, the process goes from decision block 510 to function block 502.

In decision block 508, if the railway vehicle is positioned outside the zone controlled by the subject wayside controller, then in function block 512, the subject WVC transfers control of the railway vehicle to the adjacent WVC that controls the zone into which the railway vehicle has proceeded. After transfer of control, the process goes to decision block 510.

Figure 6:
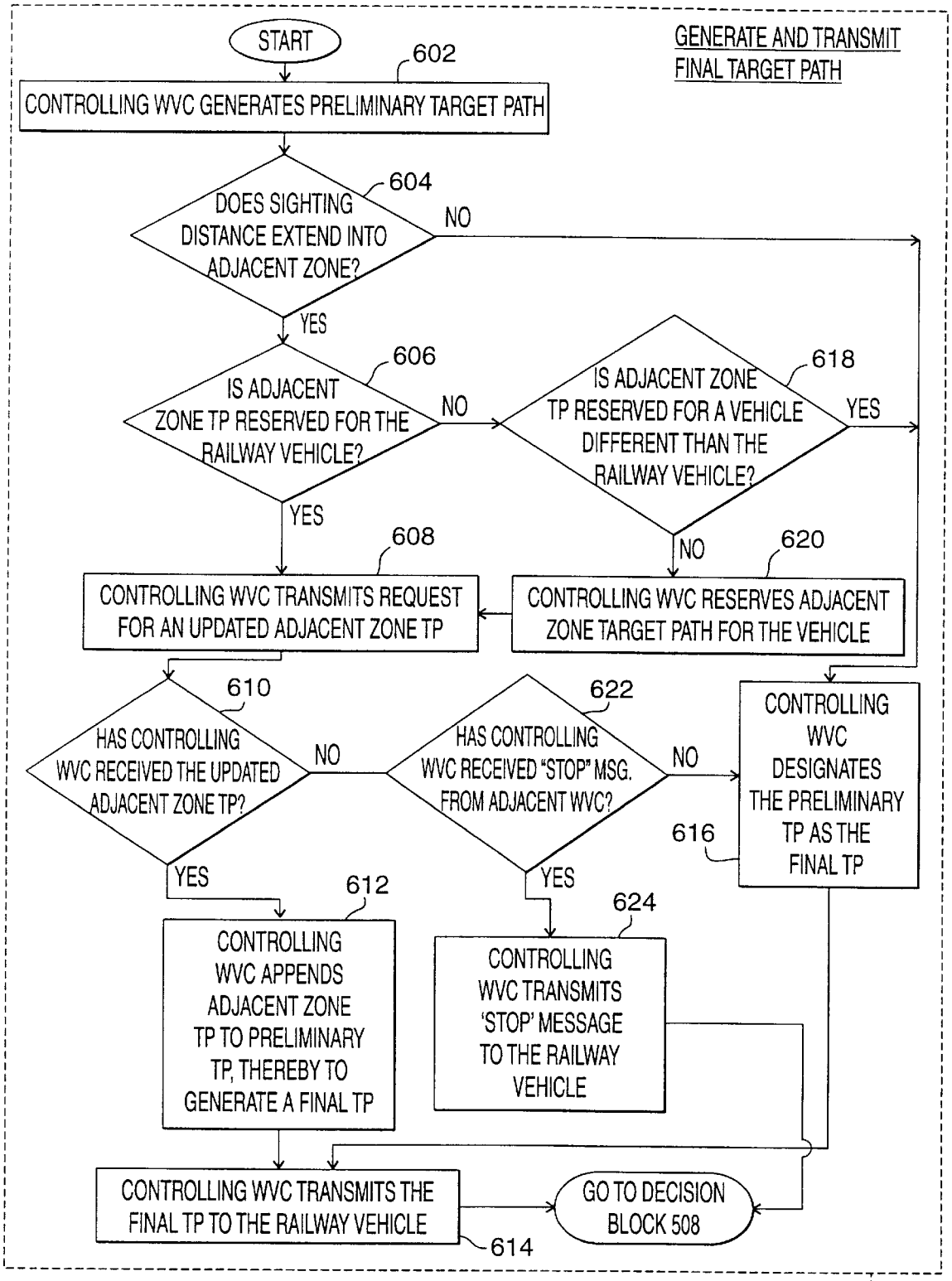
FIG. 6 depicts a more detailed flow diagram of the final target path generation steps of the method of the present invention.

FIG. 6 is a flow diagram depicting the logic for the basic final target path generation and transmission performed by the subject WVC in the function block 506 of FIG. 5. In function block 602, the subject controlling WVC generates a preliminary target path, and proceeds to decision block 604, wherein a determination is made as to whether the sighting distance for the railway vehicle that is controlled by the subject controlling WVC extends into an adjacent zone which is controlled by an adjacent WVC that is different than the subject controlling WVC—which has control of the railway vehicle. If the sighting distance does extend into an adjacent zone, a determination is then made in decision block 606 as to whether the adjacent zone target path for the adjacent zone into which the sighting distance has extended is reserved for the subject railway vehicle that is moving toward the adjacent zone and is being controlled by the subject controlling WVC. If so, the subject controlling WVC transmits a request for an updated adjacent zone target path in function block 608. In a preferred method of the present invention, the subject controlling WVC cancels the request for the updated adjacent zone target path if the railway vehicle that is controlled by the subject controlling WVC changes direction of travel (not shown) proximate to the boundaries of the zone of the subject controlling WVC.

A determination is then made in decision block 610 as to whether the subject controlling WVC has received the updated adjacent zone target path. If so, in function block 612, the subject controlling WVC appends the adjacent zone target path to the preliminary target path (as generated in function block 604), thereby to generate a final target path. In function block 614, the subject controlling WVC transmits the final target path to the railway vehicle that is being controlled by the subject controlling WVC, and the process proceeds to the decision block 508.

If the determination is made in decision block 604 that the sighting distance does not extend into an adjacent zone which is controlled by an adjacent WVC which is different than the subject controlling WVC, then the subject controlling WVC designates the preliminary target path as the final target path in function block 616, and the process goes to function block 614.

If the determination made in decision block 606 is that the adjacent zone target path is not reserved for the subject railway vehicle that is moving toward the adjacent zone and is being controlled by the subject controlling WVC, then a determination is made in decision block 618 as to whether the adjacent zone target path is reserved for a vehicle that is different than the subject railway vehicle. If so, the subject controlling WVC designates the preliminary target path as the final target path in function block 616, and the process goes to function block 614. If not, the subject controlling WVC reserves the adjacent zone target path for the subject railway vehicle in function block 620, and the process proceeds to the function block 608.

If the determination made in decision block 610 is that the subject controlling WVC has not received the updated adjacent zone target path, then a determination is made in decision block 622 as to whether the subject controlling WVC has received, from the adjacent WVC, an emergency message, such as a "stop" message, for instance. If so, the subject controlling WVC transmits the emergency "stop" message to the subject railway vehicle in function block 624, and the process proceeds to the decision block 508. If the subject controlling WVC has not received an emergency message at decision block 622, the process proceeds to function block 616.

Figure 7:
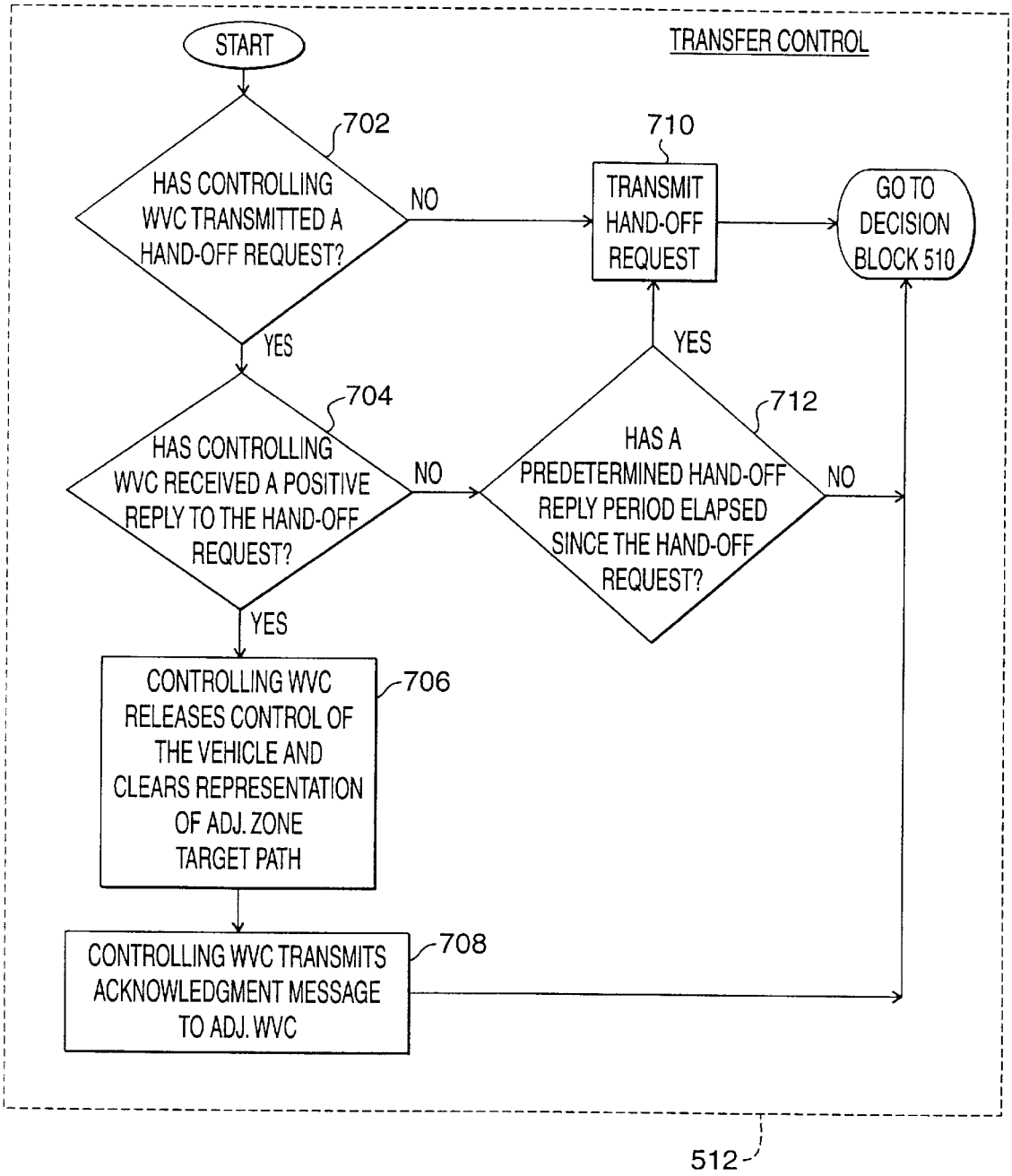
FIG. 7 depicts a more detailed flow diagram of the control transfer steps of the method of the present invention, as performed by a controlling wayside vital controller.

FIG. 7 is a flow diagram depicting the logic for transfer of control to the adjacent wayside vital controller performed by the subject controlling WVC in the function block 512 of FIG. 5. In decision block 702, a determination is made as to whether the subject controlling WVC has transmitted a hand-off request, thereby to initiate the transfer of control of the subject railway vehicle. If so, a determination is made in decision block 704 as to whether the subject controlling WVC has received a positive reply to the hand-off request, thereby indicating to the subject controlling WVC that the adjacent WVC has made a determination (refer to FIG. 11) that the adjacent WVC is available to accept control of the subject railway vehicle. If so, in function block 706, the subject controlling WVC releases control of the subject railway vehicle and clears the internal representation of the adjacent zone target path, which is a preferred manner of releasing control for the subject controlling wayside vital controller, thereby resetting the subject controlling WVC. At this moment, the controlling wayside vital controller is no longer in control of the railway vehicle and is free to request an adjacent zone target path from another adjacent wayside vital controller for a different railway vehicle.

Also at this moment, the adjacent wayside vital controller has not yet freed its own internal representation of the adjacent zone target path for the subject railway vehicle, so if the controlling wayside vital controller requests an adjacent zone target path, the adjacent wayside vital controller will reject the request.

Also at this moment, neither the controlling wayside vital controller nor the adjacent wayside vital controller has ownership of the subject railway vehicle. In fact, at this moment, the controlling wayside vital controller has no knowledge at all of the subject railway vehicle. This lack of knowledge by the controlling wayside vital controller is appropriate because neither the subject railway vehicle nor its target path is positioned within the zone controlled by the controlling wayside vital controller. The adjacent wayside vital controller has knowledge of the subject railway vehicle's position within the zone controlled by the adjacent wayside vital controller because the adjacent wayside vital controller still has the adjacent zone target path which identifies the subject railway vehicle's complete normal target path. The lack of ownership of the railway vehicle at this moment in the transfer of control is preferable to the alternative of simultaneous ownership by both the subject WVC and the adjacent WVC, which simultaneous ownership may result in contradictory target path messages being transmitted to the railway vehicle. If the transmission dialogue between the subject controlling WVC and the adjacent WVC is not completed (for instance, if the next message in the transmission dialogue is lost), the railway vehicle must notice that a new target path message has not been received after a predetermined period, and therefore must initiate a recovery process (the recovery process is outside the scope of the method of the present invention and is not described herein).

The subject controlling WVC transmits an acknowledgment message to the adjacent WVC in function block 708 and the process goes to decision block 510 in FIG. 5. The acknowledgment message indicates that the subject controlling WVC has given up ownership of the subject railway vehicle.

If the determination made in decision block 702 is that the subject controlling WVC has not transmitted a hand-off request, thereby to initiate the transfer of control of the subject railway vehicle, then in function block 710, the subject controlling WVC transmits a hand-off request, and the process goes to decision block 510 in FIG. 5.

If the determination made in decision block 704 is that the subject controlling WVC has not received a positive reply to the hand-off request, then a determination is made in decision block 712 as to whether a predetermined hand-off reply period has elapsed since the hand-off request. If so, then the process goes to function block 710. If not, then no adjacent WVC is available to accept control of the subject railway vehicle from the subject controlling WVC, and the process goes to decision block 510 in FIG. 5, thereby to retain control of the subject railway vehicle until a new hand-off request is transmitted after the predetermined cycle for the subject controlling WVC. The adjacent WVC may not be able to accept control of the subject railway vehicle, for instance, if the adjacent WVC already controls a maximum permitted number of other railway vehicles.

Figure 8:
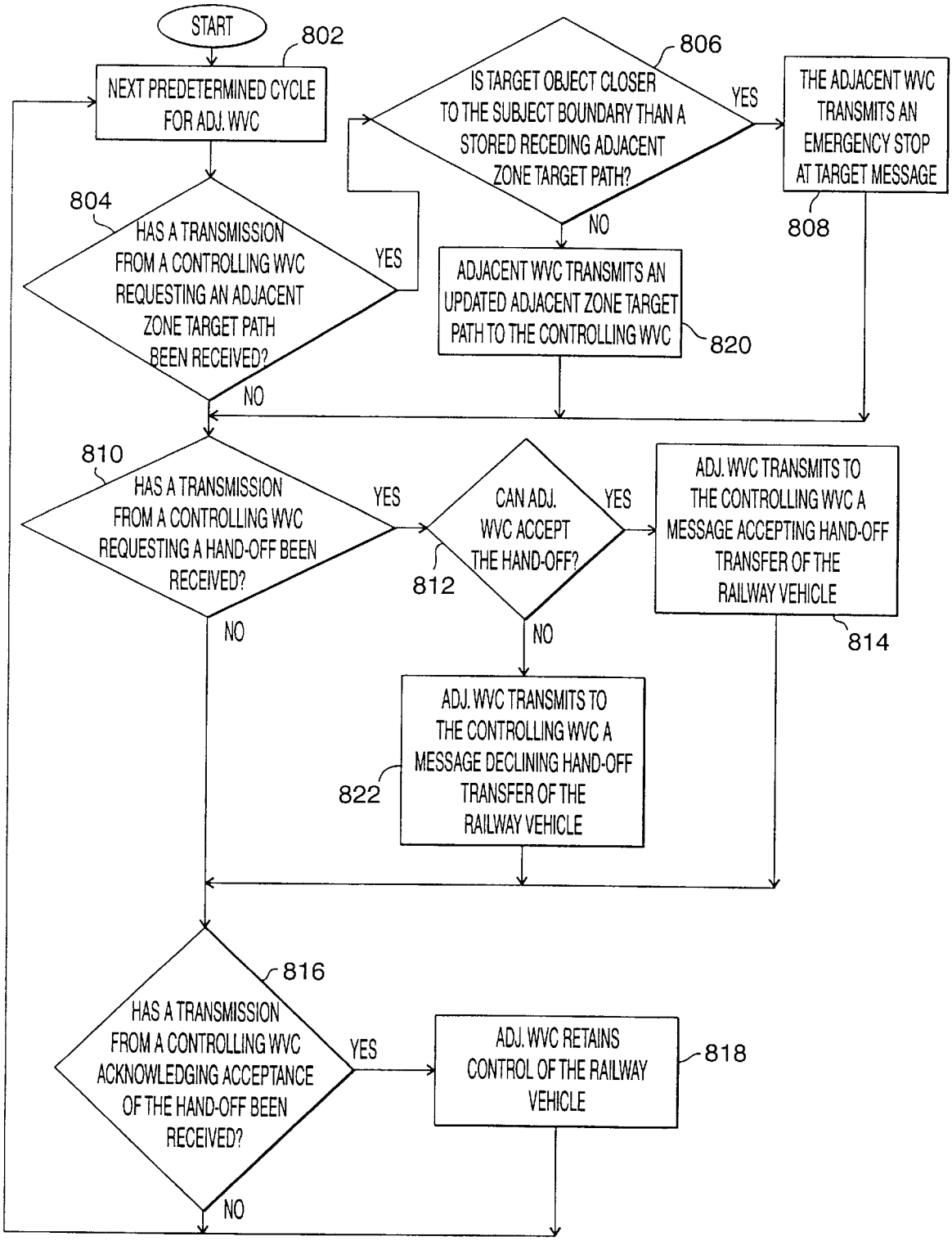
FIG. 8 depicts a flow diagram of the steps asynchronously performed by an adjacent wayside controller independently and in parallel with the steps of FIGS. 5–7 performed by the controlling wayside controller.

FIG. 8 is a flow diagram depicting the logic for each adjacent WVC which controls a particular zone of the railway system in accordance with the method of the present invention. The logic of FIG. 8 is performed by a particular subject adjacent WVC asynchronously, independently, and in parallel with the logic performed in FIGS. 5–7 by a particular subject controlling WVC. For the particular subject adjacent WVC, the subject adjacent WVC waits for the next predetermined cycle for that subject adjacent WVC in function block 802.

At the next predetermined cycle, a determination is made in decision block 804 as to whether the subject adjacent WVC has received a transmission from a controlling WVC requesting an adjacent zone target path. (As previously described, a subject boundary separates the zone controlled by the subject adjacent WVC and the zone controlled by the subject controlling WVC.) If the transmission from the controlling WVC has been received, a determination is then made in decision block 806 as to whether any target object that may exist in the zone controlled by the subject adjacent WVC is closer to the subject boundary than is an adjacent zone target path that was previously generated and stored by the subject adjacent WVC. If so, in function block 808, the subject adjacent WVC transmits an emergency message, for instance, a "stop" message or a "stop at target" message. A determination is then made in decision block 810 as to whether the subject adjacent WVC has received a transmission from a controlling WVC requesting a hand-off of a subject railway vehicle that is controlled by a controlling WVC in an adjacent zone. If so, a determination is then made in decision block 812 as to whether the subject adjacent WVC has the ability to accept the hand-off of the railway vehicle. The adjacent WVC may be already controlling a maximum limit of railway vehicles due to capacity limitations with computing power or memory, for instance.

If the subject WVC may accept the hand-off of the railway vehicle from the subject controlling WVC, then in function block 814, the adjacent WVC transmits to the controlling WVC a message accepting hand-off of the railway vehicle from the subject controlling WVC. A determination is then made in decision block 816 as to whether the subject adjacent WVC has received a transmission from the subject controlling WVC acknowledging acceptance of the hand-off of the subject railway vehicle. If so, in function block 818, the subject adjacent WVC retains control of the subject railway vehicle, and then the process proceeds to the function block 802. If not, the process proceeds directly to the function block 802 without the subject adjacent WVC retaining control of the subject railway vehicle, and control of the subject railway vehicle remains with the subject controlling WVC until an adjacent WVC may accept control after a received transmission of another hand-off request in another cycle for the adjacent WVC.

If the determination made in decision block 804 is that the subject adjacent WVC has not received a transmission from another adjacent WVC that is different from the subject adjacent WVC, then the process goes directly to decision block 810.

If the determination is made in decision block 806 is that any target object that may exist in the zone controlled by the subject adjacent WVC is not closer to the subject boundary than is an adjacent zone target path that was previously generated and stored by the subject adjacent WVC, then in function block 820, the subject adjacent WVC transmits an updated adjacent zone target path, to be received by the subject controlling WVC. The process then goes to the decision block 810.

If the determination made in decision block 810 is that the subject adjacent WVC has not received a transmission from a controlling WVC requesting a hand-off of a subject railway vehicle that is controlled by a controlling WVC in an adjacent zone, then the process goes directly to the decision block 816.

If, in the decision block 812, the subject WVC may not accept the hand-off of the railway vehicle from the subject controlling WVC, then in function block 822, the adjacent WVC transmits to the controlling WVC a message declining hand-off of the railway vehicle from the subject controlling WVC. The process then proceeds to the decision block 816.

Figure 9:
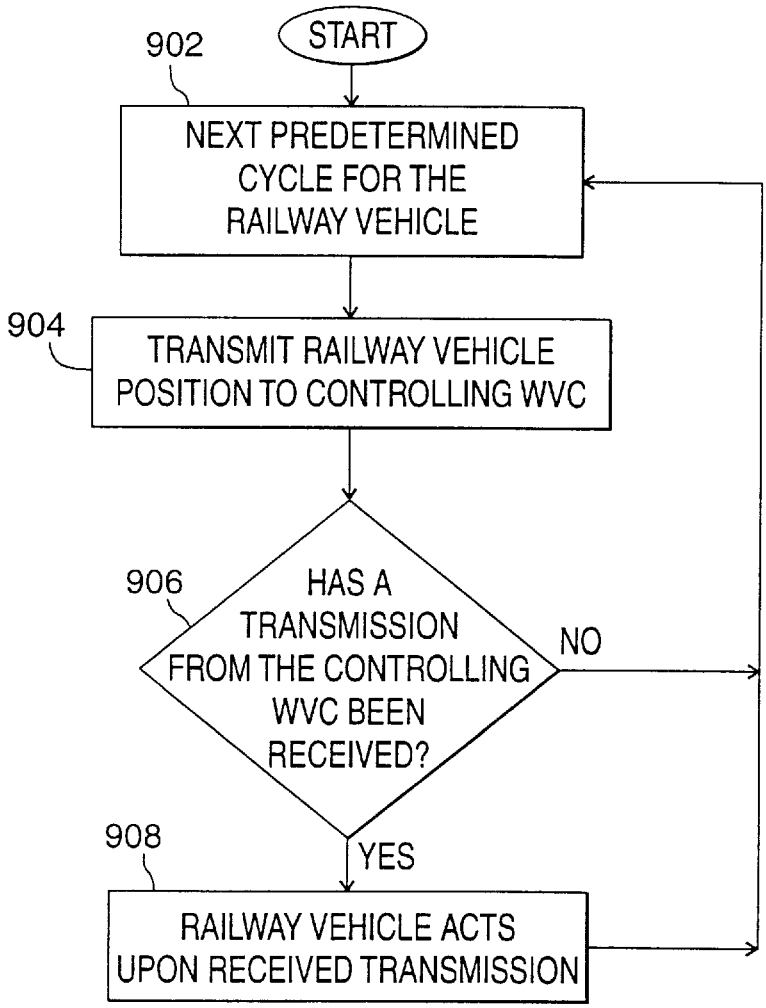
FIG. 9 depicts a flow diagram of the steps asynchronously performed by the railway vehicle independently and in parallel with the steps of FIGS. 5–7 performed by the controlling wayside controller and the steps of FIG. 8 performed by the adjacent wayside controller, in accordance with a preferred method of the present invention.

FIG. 9 is a flow diagram depicting the logic for each railway vehicle that is under the control of the controlling WVC which controls the zone in which the railway vehicle is traveling. The logic of FIG. 9 is performed by a particular subject railway vehicle asynchronously, independently, and in parallel with the logic performed in FIGS. 5–7 by a particular subject controlling WVC and in FIG. 8 by a particular subject adjacent WVC. In function block 902, for a particular subject railway vehicle, the subject railway vehicle waits for the next predetermined cycle for that subject railway vehicle.

At the next predetermined cycle for the subject railway vehicle, in function block 904, the subject railway vehicle transmits its own position to the controlling WVC. A determination is made in decision block 906 as to whether the subject railway vehicle has received any transmission from the controlling WVC which controls the zone in which the railway vehicle is traveling. If so, in function block 908, the subject railway vehicle acts upon the received transmission, and the process goes to function block 902. If the determination made in decision block 906 is that the subject railway vehicle has not received any transmission from the controlling WVC which controls the zone in which the railway vehicle is traveling, then the process goes directly to function block 902.

Figure 10:
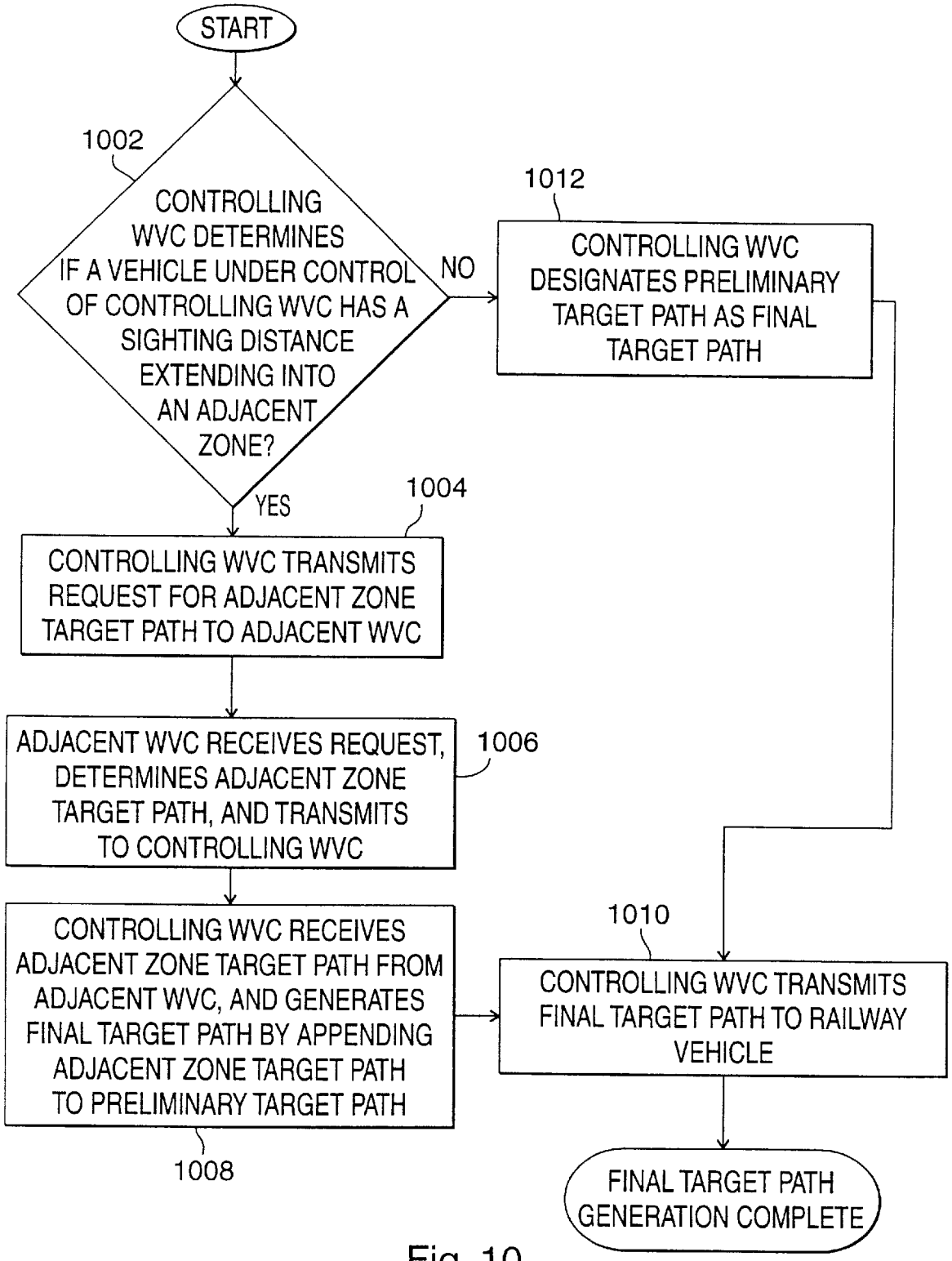
FIG. 10 is a flow diagram depicting the logic for the interaction between the controlling wayside controller and the adjacent wayside controller for the generation of the final target path in accordance with a preferred method of the present invention.

FIG. 10 is a flow diagram depicting the logic for the interaction between the controlling WVC and the adjacent WVC for the generation of the final target path. A determination is made by the controlling WVC in decision block 1002 as to whether a railway vehicle under control of the controlling WVC has a sighting distance that extends into an adjacent zone which is controlled by the adjacent WVC. If so, in function block 1004, the controlling WVC transmits a request to the adjacent WVC for an adjacent zone target path. In function block 1006, the adjacent WVC receives the request, determines the adjacent zone target path, and transmits the adjacent zone target path to the controlling WVC. In function block 1008, the controlling WVC receives the adjacent zone target path from the adjacent WVC, and generates the final target path by appending the adjacent zone target path to the previously generated preliminary target path (refer to FIG. 6). In function block 1010, the controlling WVC transmits the final target path to the railway vehicle, thereby to complete generation of the final target path.

If the determination made in decision block 1002 is that a railway vehicle under control of the controlling WVC does not have a sighting distance that extends into an adjacent zone which is controlled by the adjacent WVC, then in function block 1012, the controlling WVC designates the previously generated preliminary target path (refer to FIG. 6) as the final target path. The process then goes to function block 1010.

Figure 11:
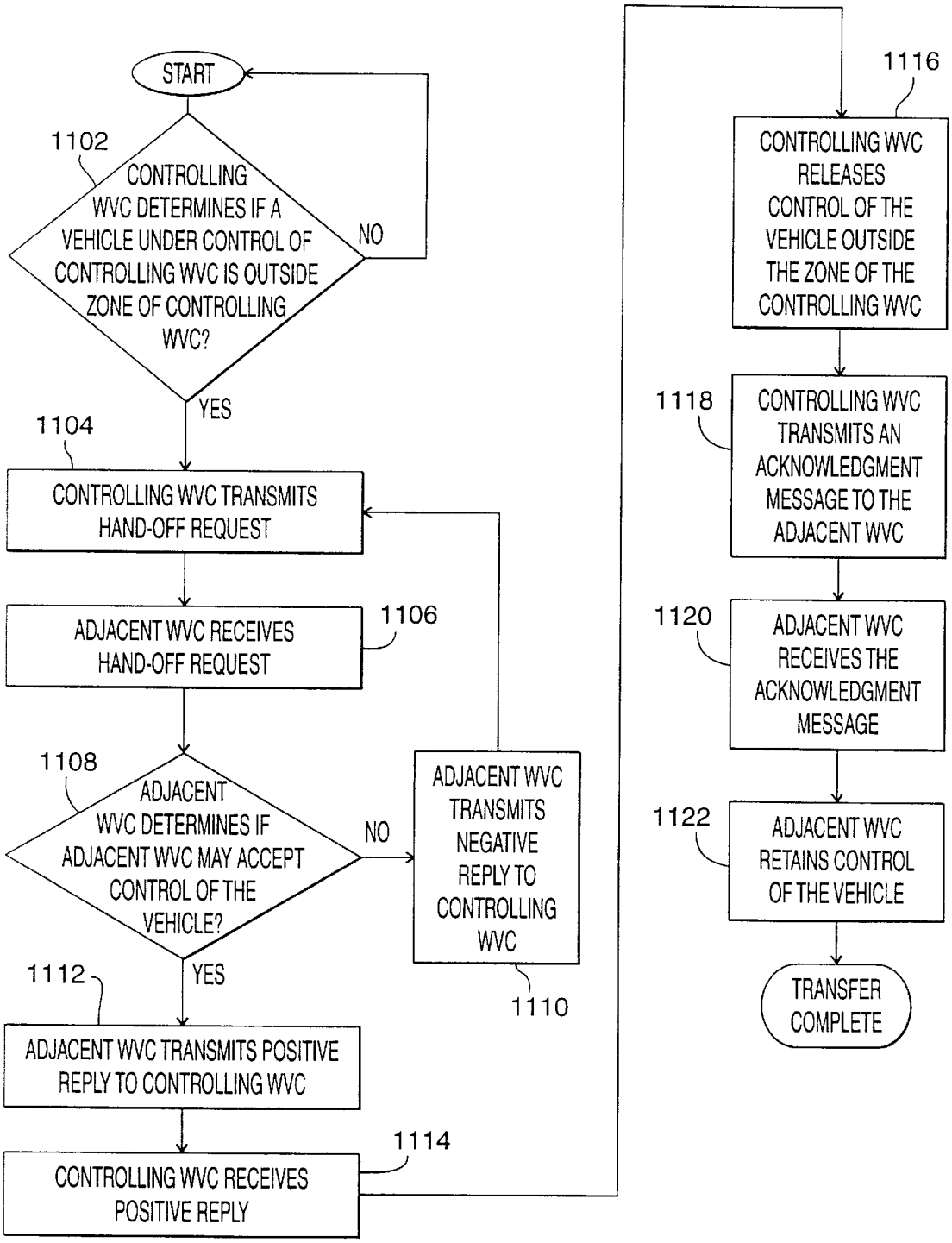
FIG. 11 is a flow diagram depicting the logic for the interaction between the controlling wayside controller and the adjacent wayside controller for the transfer of control from the controlling wayside controller to the adjacent wayside controller, in accordance with a preferred method of the present invention.

FIG. 11 is a flow diagram depicting the logic for the interaction between the controlling WVC and the adjacent WVC for the transfer of control from the controlling WVC to the adjacent WVC. A determination is made by the controlling WVC in decision block 1102 as to whether a railway vehicle that is presently under control of the controlling WVC has traveled outside of the zone which is controlled by the controlling WVC. If not, no transfer of control is required, and the interaction process stays with the controlling WVC at decision block 1102 because the controlling WVC has no need to interact with the adjacent WVC to transfer control. However, if the determination made by the controlling WVC in decision block 1102 is that a railway vehicle that is presently under control of the controlling WVC has traveled outside of the zone which is controlled by the controlling WVC, then in function block 1104, the controlling WVC transmits a hand-off request to the adjacent WVC, thereby to initiate a potential transfer of control. In function block 1106, the adjacent WVC receives the hand-off request. A determination is then made by the adjacent WVC in decision block 1108 as to whether the adjacent WVC may accept control of the railway vehicle. If not, such as, for instance, the adjacent WVC is controlling a maximum capacity of different railway vehicles within the adjacent zone controlled by the adjacent WVC, then in function block 1110, the adjacent WVC transmits a negative reply to the controlling WVC. The process is then repeated with the controlling WVC transmitting another hand-off request in function block 1104.

If however, a determination is made by the adjacent WVC in decision block 1108 that the adjacent WVC may accept control of the railway vehicle, then in function block 1112 the adjacent WVC transmits a positive reply to the controlling WVC. In function block 1114, the controlling WVC receives the positive reply. In function block 1116, the controlling WVC releases control of the railway vehicle that is now outside of the zone of the controlling WVC. In function block 1118, the controlling WVC transmits an acknowledgment message to the adjacent WVC, thereby indicating that control of the railway vehicle has been released by the controlling WVC and that the controlling WVC is no longer the controlling WVC of that railway vehicle. In function block 1120, the adjacent WVC receives the acknowledgment message. In function block 1122, the adjacent WVC retains control of the railway vehicle—thereby completing the transfer of control and establishing the adjacent WVC as the controlling WVC for that railway vehicle.

The foregoing description of the preferred embodiment of the method of the present invention has been presented for purposes of illustration and description. It is not intended to be exhaustive or to limit the present invention to the precise form disclosed, and obviously many modifications and variations are possible in light of the above teachings.

The preferred embodiment of the method of the present invention was chosen and described in order to best explain the principles of the present invention and its practical application to those persons skilled in the art of transferring control of a railway vehicle in a communication based signaling system, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A method of transferring control of a first railway vehicle having a head and a tail from a first wayside controller that controls a first zone within which the railway vehicle is positioned, to a second wayside controller that controls a second zone separated from the first zone by a boundary in a communication based signaling system, comprising the steps of:

(a) generating a final target path that provides clearance in the communication based signaling system that utilizes moving blocks to provide improved positioning of the first railway vehicle, said final target path to be relayed by the first wayside controller to the first railway vehicle as the first railway vehicle approaches the boundary;

(b) relaying a message from the first wayside controller to the first railway vehicle;

(c) transferring control from the first wayside controller to the second wayside controller after both the head and the tail of the first railway vehicle crosses the boundary.

2. The method of transferring control according to claim 1, further comprising the steps of:

(p) repeating steps (a), (b), and (c) for each railway vehicle that is different than the first railway vehicle and that is controlled by the first wayside controller.

3. A method of transferring control of a first railway vehicle having a head and a tail from a first wayside controller that controls a first zone within which the railway vehicle is positioned, to a second wayside controller that controls a second zone separated from the first zone by a boundary in a communication based signaling system, comprising the steps of:

(a) generating a final target path to be relayed by the first wayside controller to the first railway vehicle as the first railway vehicle approaches the boundary;

(b) relaying a message from the first wayside controller to the first railway vehicle;

(c) transferring control from the first wayside controller to the second wayside controller after both the head and the tail of the first railway vehicle crosses the boundary;

wherein step (a) further comprises the steps of:

(d) generating a preliminary target path from the tail of the first railway vehicle to the nearer of either the boundary or a predetermined sighting distance;

(e) determining when said predetermined sighting distance extends from the first zone, past the boundary, and into the second zone;

(f) requesting an updated adjacent zone target path from the second wayside controller if said predetermined sighting distance extends into the second zone;

(g) receiving said updated adjacent zone target path from the second wayside controller; and (h) appending said updated adjacent zone target path to the preliminary target path.

4. The method of claim 3, wherein the message relayed in step (b) is an emergency stop at target message when a target is proximally closer to the train than a previously generated final target path.

5. The method of claim 3, wherein the message relayed in step (b) is a cancel adjacent zone target message when the first railway vehicle changes direction proximate to the boundary.

6. The method of transferring control according to claim 3, further comprising the steps of:

(p) repeating steps (a), (b), and (c) for each railway vehicle that is different than the first railway vehicle and that is controlled by the first wayside controller.

7. A method of transferring control of a first railway vehicle having a head and a tail from a first wayside controller that controls a first zone within which the railway vehicle is positioned, to a second wayside controller that controls a second zone separated from the first zone by a boundary in a communication based signaling system, comprising the steps of:

(a) generating a final target path to be relayed by the first wayside controller to the first railway vehicle as the first railway vehicle approaches the boundary;

(b) relaying a message from the first wayside controller to the first railway vehicle;

(c) transferring control from the first wayside controller to the second wayside controller after both the head and the tail of the first railway vehicle crosses the boundary;

wherein step (c) further comprises the steps of:

(d) relaying a hand-off request message from the first wayside controller to the second wayside controller;

(e) relaying a first acknowledgment message from the second wayside controller to the first wayside controller, wherein said first acknowledgment message is a positive acknowledgment when control of the first railway vehicle may be transferred to the second wayside controller and otherwise, said acknowledgment message is a negative acknowledgment;

(f) releasing control of the first railway vehicle and canceling said adjacent zone target path by the first wayside controller upon receipt of said positive acknowledgment from said second wayside controller;

(g) relaying a second positive acknowledgment message from the first wayside controller to the second wayside controller after the first wayside controller has released control of the first railway vehicle;

(h) initiating control of the first railway vehicle by the second wayside controller upon receipt of said second positive acknowledgment message from the first wayside controller; and (i) canceling said adjacent zone target path by the second wayside controller.

8. The method of transferring control according to claim 7, further comprising the steps of:

(p) repeating steps (a), (b), and (c) for each railway vehicle that is different than the first railway vehicle and that is controlled by the first wayside controller.

9. A method of transferring control of a first railway vehicle, from a first wayside controller that controls a first zone within which the railway vehicle is positioned, to a second wayside controller that controls a second zone that is adjacent the first zone and separated from the first zone by a predetermined boundary in a communication based signaling system, comprising the steps of:

(a) periodic monitoring by the first wayside controller of a position of the first railway vehicle, in parallel with periodic monitoring by the second wayside controller for receipt of a first transmission from the first wayside controller, in parallel with periodic monitoring by the first railway vehicle for receipt of a second transmission from the first wayside controller;

(b) generating by the first wayside controller of a final target path;

(c) transmitting said final target path to the railway vehicle; and (d) transferring control of the first railway vehicle from the first wayside controller to the second wayside controller when said position of the first railway vehicle is outside the first zone and within the second zone.

10. The method of claim 9, wherein step (d) further comprises the steps of:

(e) transmitting by the first wayside controller of a request to accept control of the first railway vehicle by the second wayside controller;

(f) retaining control of the first railway vehicle by the first wayside controller and proceeding to step (a) when the second wayside controller declines acceptance of control;

(g) releasing control of the first railway vehicle and transmitting a release of control message by the first wayside controller upon receipt of a transmitted acknowledgment of control acceptance by the second wayside controller; and (h) retaining control of the first railway vehicle by the second wayside controller upon receipt of said release of control message, and proceeding to step (a).

11. The method of claim 9, wherein step (b) further comprises the steps of:

(i) generating by the first wayside controller of a preliminary target path; and (j) appending an adjacent zone target path to said preliminary target path.

12. The method of claim 11, further comprising the following steps after step (i) and before step (j):

(q) receiving a stop message; and (r) transmitting said stop message to the first railway vehicle by the first wayside controller and transmitting said preliminary target path as said final target path to the first railway vehicle and proceeding to step (a) upon receipt of said stop message by the first wayside controller.

13. The method of claim 9, wherein step (b) further comprises the steps of:

(k) generating by the first wayside controller of a preliminary target path; and (l) designating said preliminary target path as said final target path.

14. The method of claim 13, further comprising the following steps after step (k) and before step (l):

(q) receiving a stop message; and (r) transmitting said stop message to the first railway vehicle by the first wayside controller and transmitting said preliminary target path as said final target path to the first railway vehicle and proceeding to step (a) upon receipt of said stop message by the first wayside controller.

15. The method of claim 9, wherein step (b) further comprises the steps of:

(m) generating by the first wayside controller of a preliminary target path;

(n) requesting an updated adjacent zone target path from the second wayside controller;

(o) receiving said updated adjacent zone target path from the second wayside controller; and (p) generating said final target path by appending said updated adjacent zone target path to said preliminary target path.

16. The method according to claim 9, wherein said periodic monitoring by the second wayside controller for receipt of a first transmission from the first wayside controller of step (a) further comprises the steps of:

(s) waiting a predetermined second wayside controller cycle;

(t) transmitting by the second wayside controller of a stop message upon receipt of a transmission request from the first wayside controller and a target is closer to the predetermined boundary than a previously stored adjacent zone target path and proceeding to step (s); and (u) transmitting by the second wayside controller of an updated adjacent zone target path upon receipt of a transmission request from the first wayside controller and said previously stored adjacent zone target path is closer to the predetermined boundary than said target and proceeding to step (s).

17. The method according to claim 9, wherein said periodic monitoring by the first railway vehicle for receipt of a second transmission from the first wayside controller of step (a) further comprises the steps of:

(t) waiting a predetermined railway vehicle cycle;

(u) transmitting by the railway vehicle of a railway vehicle position to the first wayside vital controller; and (v) responding to a transmission received from the first wayside controller upon receipt of said transmission and otherwise proceeding to step (t).

18. A method of transferring control of a first railway vehicle that is traveling in a first direction and has a head and a tail, from a first wayside controller that controls a first zone within which the railway vehicle is positioned, to a second wayside controller that controls a second zone that is adjacent the first zone and separated from the first zone by a predetermined boundary in a communication based signaling system, comprising the steps of:

(a) periodic monitoring by the first wayside controller of a position and a sighting distance of the first railway vehicle, to determine if the first railway vehicle has a vehicle position within the first zone and if said sighting distance extends from the first zone, past the predetermined boundary and into the second zone;

(b) in parallel with step (a), monitoring by the second wayside controller to determine if a transmission to the second wayside controller has been received;

(c) in parallel with steps (a) and (b), monitoring by the railway vehicle to determine if a transmission to the railway vehicle has been received;

(d) generating and transmitting a final target path to the first railway vehicle; and (e) transferring control of the first railway vehicle to the second wayside controller.

19. The method of claim 18, wherein step (d) further comprises the steps of:

(f) when the railway vehicle has a vehicle position within the first zone and said sighting distance extends from the first zone, past the predetermined boundary and into the second zone, generating by the first wayside controller of a preliminary target path beginning at the tail of the railway vehicle and ending at the predetermined boundary;

(g) when said sighting distance extends from the first zone, past the predetermined boundary and into the second zone, reserving by the first wayside controller of a current adjacent zone target path for the railway vehicle if said current adjacent zone target path is otherwise unreserved;

(h) when said sighting distance extends from the first zone, past the predetermined boundary and into the second zone, and if said current adjacent zone target path is reserved for the railway vehicle, transmitting a sighting distance and a request to the second wayside controller from the first wayside controller for an updated adjacent zone target path from the second wayside controller;

(i) upon receipt of said sighting distance by the second wayside controller, generating by the second wayside controller of a current adjacent zone target path beginning at the predetermined boundary and ending at the closer in distance of said sighting distance and a target within the second zone;

(j) transmitting a reply to the first wayside controller from the second wayside controller, wherein said reply is a stop-at-target message if said target is closer in distance than a preceding adjacent zone target path that was transmitted and stored by the second wayside controller prior to calculating said current adjacent zone target path, and otherwise, wherein said reply is said current adjacent zone target path to replace said preceding adjacent zone target path;

(k) when said reply is said current adjacent zone target path, upon receipt of said current adjacent zone target path by the first wayside controller, if said current adjacent zone target path is reserved for a second railway vehicle that is different than the first railway vehicle, generating by the first wayside controller of a final target path that is equivalent to said preliminary target path;

(l) when said reply is said current adjacent zone target path, upon receipt of said current adjacent zone target path by the first wayside controller, if said current adjacent zone target path is reserved for the first railway vehicle generating by the first wayside controller of said final target path that is equivalent to a concatenation of said current adjacent zone target path with said preliminary target path;

(m) transmitting by the first wayside controller said final target path to said first railway vehicle; and (n) continuously repeating the above sequence of steps while the railway vehicle is moving in the first direction and the railway vehicle has a vehicle position within the first zone.

20. The method of claim 18, wherein step (e) further comprises the steps of:

(o) when the railway vehicle has a vehicle position that is outside of the first zone, transmitting a hand-off request and said vehicle position to the second wayside controller from the first wayside controller;

(p) upon receipt of said hand-off request by the second wayside controller from the first wayside controller, when the second wayside controller may accept control of the railway vehicle, transmitting an acknowledgment reply to the first wayside controller;

(q) upon receipt of said acknowledgment reply by the first wayside controller from the second wayside controller, releasing control of the railway vehicle by the first wayside controller;

(r) upon release of control of the railway vehicle by the first wayside controller, transmitting an acknowledge message to the second wayside controller; and (s) upon receipt of said acknowledgment message by the second wayside controller from the first wayside controller, retaining control of the railway vehicle by the second wayside controller and releasing the current adjacent zone target path.

21. The method of claim 19, wherein step (e) further comprises the steps of:

(o) when the railway vehicle has a vehicle position that is outside of the first zone, transmitting a hand-off request and said vehicle position to the second wayside controller from the first wayside controller;

(p) upon receipt of said hand-off request by the second wayside controller from the first wayside controller, when the second wayside controller may accept control of the railway vehicle, transmitting an acknowledgment reply to the first wayside controller;

(q) upon receipt of said acknowledgment reply by the first wayside controller from the second wayside controller, releasing control of the railway vehicle by the first wayside controller;

(r) upon release of control of the railway vehicle by the first wayside controller, transmitting an acknowledge message to the second wayside controller; and (s) upon receipt of said acknowledgment message by the second wayside controller from the first wayside controller, retaining control of the railway vehicle by the second wayside controller and releasing the current adjacent zone target path.

22. The method of claim 18, further comprising the following step:

(m) transmitting a cancel message to the second wayside controller from the first wayside controller when the railway vehicle changes direction to travel in a second direction that is different than the first direction before said sighting distance extends from the first zone, past the predetermined boundary and into the second zone.

23. A method of transferring control of a first railway vehicle that is traveling in a first direction, from a first wayside controller that controls a first zone, to a second wayside controller that controls a second zone that is adjacent the first zone and separated from the first zone by a predetermined boundary in a communication based signaling system, comprising the steps of:

(a) waiting a predetermined period of time by the first wayside controller;

(b) determining that the first wayside controller that controls the first zone has control of the first railway vehicle;

(c) generating a final target path that provides clearance in the communication based signaling system that utilizes moving blocks to provide improved positioning of the first railway vehicle, for transmission of said final target path to the first railway vehicle;

(d) transmitting said final target path to the first railway vehicle;

(e) determining that the first railway vehicle is positioned outside of the first zone; and (f) transferring control of the first railway vehicle to the second wayside controller.

24. A method of transferring control of a first railway vehicle that is traveling in a first direction, from a first wayside controller that controls a first zone, to a second wayside controller that controls a second zone that is adjacent the first zone and separated from the first zone by a predetermined boundary in a communication based signaling system, comprising the steps of:

(a) waiting a predetermined period of time by the first wayside controller;

(b) determining that the first wayside controller that controls the first zone has control of the first railway vehicle;

(c) generating a final target path for transmission to the first railway vehicle;

(d) transmitting said final target path to the first railway vehicle;

(e) determining that the first railway vehicle is positioned outside of the first zone; and (f) transferring control of the first railway vehicle to the second wayside controller;

further comprising the following step after step (a):

(t) transmitting a cancel message to the second wayside controller from the first wayside controller when the railway vehicle changes direction to travel in a second direction that is different than the first direction before said sighting distance extends from the first zone, past the predetermined boundary and into the second zone.

25. The method of transferring control according to claim 23, further comprising the steps of:

(s) repeating steps (c), (d), (e) and (f) for each railway vehicle that is different than the first railway vehicle and that is controlled by the first wayside controller.

26. A method of transferring control of a first railway vehicle that is traveling in a first direction, from a first wayside controller that controls a first zone, to a second wayside controller that controls a second zone that is adjacent the first zone and separated from the first zone by a predetermined boundary in a communication based signaling system, comprising the steps of:

(a) waiting a predetermined period of time by the first wayside controller;

(b) determining that the first wayside controller that controls the first zone has control of the first railway vehicle;

(c) generating a final target path for transmission to the first railway vehicle;

(d) transmitting said final target path to the first railway vehicle;

(e) determining that the first railway vehicle is positioned outside of the first zone; and (f) transferring control of the first railway vehicle to the second wayside controller;

wherein step (c) further comprises the steps of:

(g) generating by the first wayside controller of a preliminary target path;

(h) determining by the first wayside controller that a sighting distance of the first railway vehicle crosses the predetermined boundary and extends into the second zone;

(i) determining by the first wayside controller that an adjacent zone target path is reserved for the first railway vehicle;

(j) transmitting by the first wayside controller a first request for an updated adjacent zone target path;

(k) determining by the first wayside controller that said updated adjacent zone target path has been received; and (l) generating by the first wayside controller of a final target path, by concatenating said preliminary target path with said updated adjacent zone target path.

27. The method of transferring control according to claim 26, wherein step (f) further comprises the steps of:

(n) transmitting by the first wayside controller of a hand-off request;

(o) determining by the first wayside controller that a positive reply to said hand-off request has been received by the first wayside controller;

(p) releasing control of the first railway vehicle by the first wayside controller;

(q) transmitting by the first wayside controller of an acknowledgment to the second wayside controller; and (r) retaining control of the first railway vehicle by the second wayside controller.

28. The method of transferring control according to claim 27, further comprising the steps of:

(s) repeating steps (c), (d), (e) and (f) for each railway vehicle that is different than the first railway vehicle and that is controlled by the first wayside controller.

29. The method of claim 27, further comprising the following step after step (a):

(t) transmitting a cancel message to the second wayside controller from the first wayside controller when the railway vehicle changes direction to travel in a second direction that is different than the first direction before said sighting distance extends from the first zone, past the predetermined boundary and into the second zone.

30. The method of transferring control according to claim 26, further comprising the steps of:

(s) repeating steps (c), (d), (e) and (f) for each railway vehicle that is different than the first railway vehicle and that is controlled by the first wayside controller.

31. The method of transferring control according to claim 26, further comprising the steps of:

(s) repeating steps (c), (d), (e) and (f) for each railway vehicle that is different than the first railway vehicle and that is controlled by the first wayside controller.

32. The method of claim 26, further comprising the following step after step (a):

(t) transmitting a cancel message to the second wayside controller from the first wayside controller when the railway vehicle changes direction to travel in a second direction that is different than the first direction before said sighting distance extends from the first zone, past the predetermined boundary and into the second zone.

33. A method of transferring control of a first railway vehicle that is traveling in a first direction, from a first wayside controller that controls a first zone, to a second wayside controller that controls a second zone that is adjacent the first zone and separated from the first zone by a predetermined boundary in a communication based signaling system comprising the steps of:

(a) waiting a predetermined period of time by the first wayside controller;

(b) determining that the first wayside controller that controls the first zone has control of the first railway vehicle;

(c) generating a final target path for transmission to the first railway vehicle;

(d) transmitting said final target path to the first railway vehicle;

(e) determining that the first railway vehicle is positioned outside of the first zone; and (f) transferring control of the first railway vehicle to the second wayside controller;

wherein step (f) further comprises the steps of:

(g) transmitting by the first wayside controller of a hand-off request;

(h) determining by the first wayside controller that a positive reply to said hand-off request has been received by the first wayside controller;

(i) releasing control of the first railway vehicle by the first wayside controller;

(j) transmitting by the first wayside controller of an acknowledgment to the second wayside controller; and (k) retaining control of the first railway vehicle by the second wayside controller.

34. The method of transferring control according to claim 33, further comprising the steps of:

(s) repeating steps (c), (d), (e) and (f) for each railway vehicle that is different than the first railway vehicle and that is controlled by the first wayside controller.

35. The method of transferring control according to claim 33, wherein step (f) further comprises the steps of:

(l) transmitting by the first wayside controller of a hand-off request;

(m) determining by the first wayside controller that a positive reply to said hand-off request has been received by the first wayside controller;

(n) releasing control of the first railway vehicle by the first wayside controller;

(o) transmitting by the first wayside controller of an acknowledgment to the second wayside controller; and (p) retaining control of the first railway vehicle by the second wayside controller.

36. The method of transferring control according to claim 35, further comprising the steps of:

(s) repeating steps (c), (d), (e) and (f) for each railway vehicle that is different than the first railway vehicle and that is controlled by the first wayside controller.

* * * * *